United States Patent [19]

Woitschatzke et al.

[11] 4,313,614

[45] Feb. 2, 1982

[54] SKI AND ITS MANUFACTURE

[75] Inventors: Hans Woitschatzke, Grunwald; Hennoch Geyer, Munich, both of Fed. Rep. of Germany

[73] Assignee: Trak Incorporated, Ward Hill, Mass.

[21] Appl. No.: 49,426

[22] Filed: Jun. 18, 1979

[30] Foreign Application Priority Data

Jun. 26, 1978 [DE] Fed. Rep. of Germany ..... 2827954

[51] Int. Cl.[3] ..... A63C 5/12

[52] U.S. Cl. ..... 280/610; 156/216

[58] Field of Search ..... 280/609, 610, 601, 28; 428/159; 156/216, 217, 78, 244.22; 9/310 A, 310 E

[56] References Cited

U.S. PATENT DOCUMENTS

| | | | |
|---|---|---|---|
| 948,866 | 2/1910 | Mennenga | 280/28 |
| 2,728,702 | 12/1955 | Simon et al. | 280/610 X |
| 3,493,240 | 2/1970 | Jenks | 280/610 |
| 3,498,626 | 3/1970 | Sullivan | 280/610 |
| 3,635,482 | 1/1972 | Holman | 280/610 |
| 3,649,398 | 4/1972 | Keith | 428/122 X |
| 3,806,389 | 4/1974 | Gwynne | 156/216 X |

FOREIGN PATENT DOCUMENTS

| | | | |
|---|---|---|---|
| 2355635 | 1/1978 | Fed. Rep. of Germany | 428/159 |

*Primary Examiner*—Joseph F. Peters, Jr.
*Assistant Examiner*—D. W. Underwood
*Attorney, Agent, or Firm*—Richard P. Crowley

[57] ABSTRACT

An improved ski, having an upper surfacing material and a lower surfacing material, the two surfacing materials being separated by, and affixed to, a core material throughout substantially the entire length of the ski, the improvement comprising a continuous belt of fiberglass reinforced laminate bonded to a polyethylene surface layer, which belt forms both the upper and lower surfacing material and which is bent around the core material so that the polyethylene layer forms the bottom running surface as well as the upper surface, the belt further forming an integral guard around the core material of the rear end of the ski.

8 Claims, 7 Drawing Figures

SKI AND ITS MANUFACTURE

BACKGROUND OF THE INVENTION

At the present time skis are primarily manufactured by one of two manufacturing methods: the injection method or the sandwich method. In both these methods the finished product is a ski having an upper belt and a lower belt which are separated by, and affixed to, a core material throughout substantially the entire length of the ski. The belts are usually polymeric laminates, often with fiber-glass reinforcement and preferably have an outer layer of hard cover material, such as polyethylene, which become the top and bottom surfaces of the finished ski. The core material may be wood or a suitable synthetic foam.

In the injection method the upper and lower belts are placed into a mold, and the hollow space remaining between them is filled-in with foam of a suitable synthetic material which adheres to the belts. This method is shown schematically in cross-section in FIG. 1.

In the sandwich method the upper and lower belts are glued under pressure to a cone made of wood or prehardened foam, sometimes also providing for air chambers. This mode of construction is shown schematically in cross-section in FIG. 2.

Skis manufactured under either method described above necessarily have the disadvantage of the core material between the upper and lower belts being exposed unprotected in the open at the rear ends of the ski. Since the core materials are softer in case of foams and more brittle in the case of wooden cores mechanical damage often occurs at this juncture and particularly when the skis are positioned upright on the ground. These problems coupled with innate deficiencies of bonded surfaces often results in spliting at the rear end of the ski.

To correct this considerable shortcoming in use, special rear end protectors have been employed up until now; they are either placed into the mold before the filling-in with foam or they are glued or screwed on to the rear end of the ski after proper preparation of the rear end of the ski such as milling-out. In any case, however, such rear end protectors require a separate assembly procedure with either the injection or sandwich methods. By the use of such rear end protectors the problem of durable protection is handled unsatisfactorily, as only a purely mechanical connection exists between the core and the rear end protectors, so that the rear ends of the ski may still be split or wedged apart by bumping or through high stress.

SUMMARY OF THE INVENTION

Our invention relates to an improved snow ski and the methods of producing such an improved ski. In particular, our invention concerns the manufacture of skis having integrated rear end guards not requiring an additional assembly step, whereby the ski may have an upper surface layer and a bottom running surface layer, formed from one continuous belt of material.

We have discovered an improved ski, particularly a cross-country ski, with the upper- and lower-belt bonded material as supporting components and a core of filler material located inbetween, the bonded material running in a longitudinal section around the rear end of the ski about the core material thereof in the general form of a U, and further characterized in that the bonded material is a single-piece, prefabricating component. Our ski is characterized in that the upper and lower belts are made out of bonded material, to which a layer of thermoplastic material with apolar properties is applied.

We have discovered that a single coherent piece of belting material may be used to surround the core material and form a "U" around the rear end of the ski. The upper- and lower belts thus do not represent two independent building parts, but become each other at the transition spot located at the U-bend. According to the invention a ski with integrated rear end guard is produced, the rear end of which is protected from core damage and spliting.

The methods we disclose herein are technically simple, efficient, and economical; the standard equipment used in either the injection or sandwich methods of constructing skis may be employed without additional assembly steps. At the same time under our improved method less belting material is wasted.

Our invention will be described and illustrated in connection with certain preferred embodiments although it is recognized that various modifications may be made without departing from the spirit and scope of our invention.

DESCRIPTION OF THE EMBODIMENTS

Figure 1:
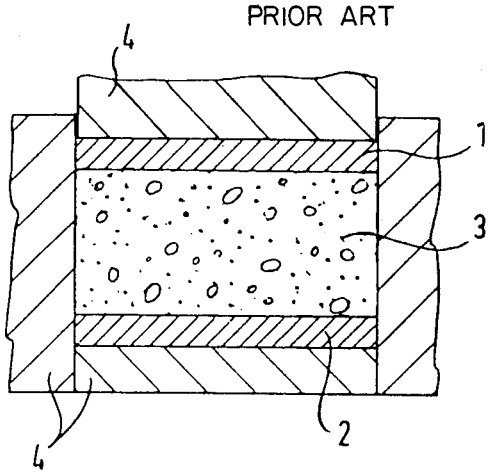
FIG. 1 PRIOR ART
FIG. 1 is an illustrative cross-sectional view of the prior art ski manufacturing method known as the injection method.
Figure 2:
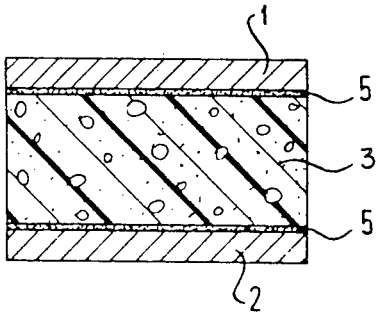
FIG. 2 PRIOR ART
FIG. 2 is an illustrative cross-sectional view of the prior art ski manufacturing method known as the sandwich method.

FIGS. 1 and 2 illustrate the two standard methods of manufacturing skis at present. In the injection method, which is shown in FIG. 1, a mold 4 is used to fabricate a ski. The upper belt 1 and lower belt 2 are placed in the mold and the mold is closed. An injection port (not shown) injects a suitable synthetic foam material 3 between the two belts until the mold is filled. The foam 3 includes an adhesive which, upon drying, caused the two belts to be firmly affixed to the foam core. Once the foam has solidified, the mold 4 is opened and the ski removed. One advantage of the injection method is that the mold can impart to the ski a finished contour, including a curled tip and central comber, without the need for additional cutting or bending. As mentioned previously, however, the traditional ski manufactured by the injection method still suffers from the defect of having the core exposed at the rear end; the additional step of attaching a rear end guard is required.

In the sandwich method, shown in FIG. 2, the upper belt 1 and the lower belt 2 are bonded to a core 3 made from wood or pre-hardened foam. The layers are bonded together by any suitable adhesive 5 under pressure. In some instances air chambers are provided to make the ski lighter or more flexible. The ski produced in this manner is typically rectangular and subsequent cutting and bending are necessary to arrive at the final ski form. Once again the ski suffers from the defect of having an exposed core at the rear end. Typically the rear end of the ski is milled after the ski has been pressed, trimed and shaped. Once the end has been milled, a properly sized guard piece is glued or screwed onto the rear end of the ski.

Figure 3:
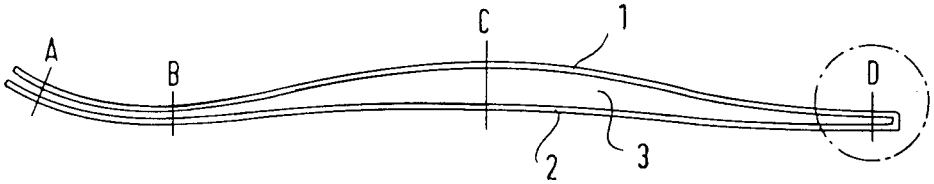
FIG. 3 is a ski according to our invention in longitudinal section.

In FIG. 3 a version of the ski according to the invention is shown in longitudinal section with exaggerated heights; a single, continuous strip of belting material forms an upper belt portion 1 and a lower belt portion 2 surrounding the core 3. Any additional layer that may be present is not shown in the schematic picture. The inner distance between upper belt 1 and lower belt 2 in a typical ski is in area A 1 to 2 mm, in area B 1.0 to 1.5 mm, in area C approximately 25 mm and in area D appr. 2 mm.

Figure 4A:
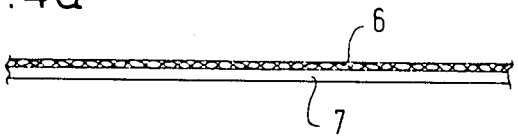
FIGS. 4*a–c* are longitudinal sections of alternate embodiments of the unitary belting material.
Figure 4B:
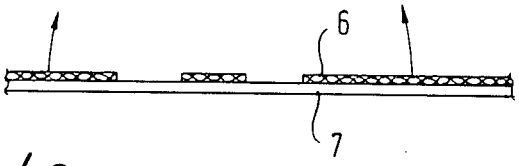
Figure 4C:
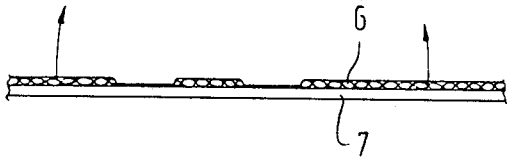

FIG. 4 shows the preferred construction of the belting material. In the preferred embodiment the belting material comprises a bonded to a hard synthetic layer, which serves as the external-layer. In the finish product this external layer forms the bottom running surface as well as the upper surface and rear end guard. Durability is a prime consideration in selecting the external layer; for this reason materials such as polyethylene are preferred. FIG. 4*a* shows a typical configuration of the belting material in schematic longitudinal section. In this embodiment a fiberglass laminate 6 is bonded to a polyethylene layer 7. FIG. 4*b* shows one embodiment of the continuous strip of belting material wherein two segments of the fiberglass laminate have been milled out to permit easy bending in the direction of the arrows. In FIG. 4*c* an alternative embodiment is shown wherein two pressed spots have been formed in the fiberglass laminate by compression, again to permit easy bending.

With the manufacture of the ski it is preferable that the notched, cut-into, milled-out or compressed spots correspond to the later thickness of the ski core (FIG. 4). It is also preferable that when cutting or milling (FIG. 4*b*) only the fiberglass laminate, and not the external surface layer be cut.

With proper selection of dimensioning and materials it is however also possible to bend the bonded material hot, without previous preparation of the planned bending edges. According to the invention bending may be done with the aid of a bending gage or a simple bending press. When the injection method is followed, the fact, that the two pieces, constituting the upper- and lower belts, are connected, additionally facilitates adjustment of the pieces in the form.

Figure 5:
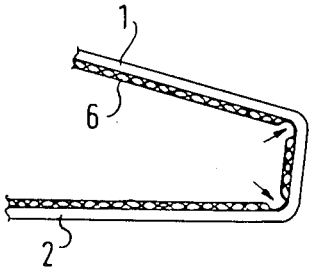
FIG. 5 is a detailed longitudinal sectional view of the belting material at the rear end of the ski.

In FIG. 5 the bending of the belting material in area D of FIG. 3 is shown enlarged schematically; with thick laminates the shaping of the rear end edges is improved by previous preparation of the bending edges (arrows) through one of the procedures mentioned above.

The ski according to the invention features several advantages in manufacture and use when compared with skis of conventional construction. The possibility of prefabricating the upper- and lower belts in one single piece, including prepared bending edges when necessary, allows savings of material and therefore a more economic and more efficient production; furthermore, the additional step of installing the rear end guard is eliminated.

The preferred use of a strip of one kind of bonded material to produce the upper- and lower belts leads to the result, that the upper surface of the ski has the same properties as the running surface. Especially with cross country skis, this has the advantage, that, because of the high apolarity and the excellent gliding properties, no snow or ice accumulates on the upper surface of the ski. At the same time, the upper and the lower surfaces may be printed on in any design desired, and the surface then sealed with a transparent layer, which results in a completely wear-proof design.

The integrated rear end guards produced, according to the invention, result in a far greater stability and resistance to wear and tear of the rear ends of the skis.

What we claim is:

1. An improved ski, which ski comprises an upper surface material and a spaced-apart, lower, gliding surface material, the upper and lower surfaces separated by a core filler material, the ski having a tip at the one end and a tail end at the other end, the improvement which comprises a single, coherent, continuous piece of bonded material extending longitudinally substantially the length of the ski and about the core material, to form the upper and lower surface material of the ski, and about the tail end of the ski, to form an integral, continuous, rear-end, tail guard of the bonded material in the general cross-sectional form of a U shape, the bonded material at the rear tail end characterized by areas of reduced thickness of the bonded material about the upper and lower corner areas of the rear-end tail guard, thereby providing an improved ski with an integral, continuous guard about the core material at the rear tail end of the ski.

2. The ski of claim 1 wherein the core filler material comprises a foam material.

3. The ski of claim 1 wherein the distance between the upper and lower surfaces of the bonding material at the rear tail end of the ski is about 2 mm.

4. The ski of claim 1 which includes a layer of adhesive material which bonds the core filler material to the bonding material forming the upper and lower surface materials.

5. The ski of claim 1 wherein the bonded material comprises a fiberglass laminate material bonded to an external layer of a synthetic, thermoplastic material, the external layer of synthetic material forming the upper and lower surfaces of the bonded material of the ski.

6. The ski of claim 5 wherein the synthetic material comprises a polyethylene material.

7. The ski of claim 5 wherein the areas of reduced thickness in the bonded material are in the fiberglass laminate material and do not extend into the synthetic material.

8. An improved ski, which ski comprises an upper surface material and a spaced-apart, lower, gliding surface material, the upper and lower surfaces separated by a foam core filler material, the ski having a tip at the one end and a tail end at the other end, the improvement which comprises a single, coherent, continuous piece of bonded material comprising a fiberglass laminate material bonded to an external layer of a synthetic, thermoplastic material, the external layer of synthetic material forming the upper and lower surfaces of the bonded material of the ski, the bonded material extending longitudinally substantially the length of the ski and about the core material, to form the upper and lower surface material of the ski, and about the tail end of the ski, to form an integral, continuous, rear-end, tail guard of the bonded material in the general cross-sectional form of a U shape, the bonded material at the rear tail end characterized by areas of reduced thickness of the bonded material about the upper and lower corner areas of the rear-end tail guard, and wherein the areas of reduced thickness in the bonded material are in the fiberglass laminate material and do not extend into the synthetic material, thereby providing an improved ski with an integral, continuous guard about the core material at the rear tail end of the ski.

* * * * *